US008145084B2

(12) United States Patent
Tsuruya

(10) Patent No.: US 8,145,084 B2
(45) Date of Patent: Mar. 27, 2012

(54) IMAGE PROCESSING APPARATUS AND METHOD

(75) Inventor: Takaaki Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 12/333,188

(22) Filed: Dec. 11, 2008

(65) Prior Publication Data

US 2009/0154964 A1 Jun. 18, 2009

(30) Foreign Application Priority Data

Dec. 14, 2007 (JP) ..... 2007-323671

(51) Int. Cl.
*G03G 15/16* (2006.01)

(52) U.S. Cl. ..... 399/66; 399/297; 399/312

(58) Field of Classification Search ..... 399/66, 399/297, 312
See application file for complete search history.

(56) References Cited

U.S. PATENT DOCUMENTS 5,153,651 A 10/1992 Kurotaka
5,499,086 A 3/1996 Matsuno et al.
6,895,195 B2 5/2005 Katamoto
2005/0111861 A1* 5/2005 Calamita et al. ..... 399/66
2007/0008397 A1* 1/2007 Maebashi ..... 347/158
2008/0175612 A1* 7/2008 Oikawa et al. ..... 399/66

FOREIGN PATENT DOCUMENTS

JP 02282770 A * 11/1990
JP 04-125676 4/1992
JP 06-149077 5/1994
JP 08-179636 7/1996
JP 2003-149960 5/2003
JP 2004-005559 1/2004
JP 2006-162642 6/2006
JP 2007-17585 1/2007

OTHER PUBLICATIONS

English Abstract to JP 02282770 A, Sasame et al.*

* cited by examiner

*Primary Examiner* — Ryan D Walsh
(74) *Attorney, Agent, or Firm* — Canon USA Inc IP Division

(57) ABSTRACT

An image forming apparatus controls the conveyance speed of a transfer material at the time a leading edge of the transfer material enters a transfer nip, to be slower than the moving speed of an image bearing member. Furthermore, the image forming apparatus controls the conveyance speed of the transfer material at the time a trailing edge of the transfer material exits the transfer nip, to be faster than the moving speed of the image bearing member.

20 Claims, 11 Drawing Sheets

IMAGE PROCESSING APPARATUS AND METHOD

BACKGROUND OF THE INVENTION

1. Field of the Invention

The present invention relates to an electrophotographic image forming apparatus, such as a printer, a copying machine, and a facsimile apparatus. More specifically, the present invention relates to an image forming apparatus configured to form a borderless image on a recording material.

2. Description of the Related Art

A conventional electrophotographic image forming apparatus forms an image on a transfer material with a margin in which no toner image is transferred.

Meanwhile, an inkjet type image forming apparatus has already been marketed that is capable of performing printing even up to the edge of a transfer material. Under these circumstances, it is desired by the market that an electrophotographic image forming apparatus can form an image even to the edge of a transfer material.

In response to such a desire, an electrophotographic image forming apparatus is discussed in Japanese Patent Application Laid-Open No. 2004-005559. For example, an electrophotographic color image forming apparatus employing an intermediate transfer member forms a toner image on an intermediate transfer member in a size larger than the size of a toner image on a transfer material in order to surely form an image up to the edge of the transfer material.

However, if a toner image whose area exceeds the edge of a transfer material such as a paper sheet is formed on an intermediate transfer member and if the toner image is transferred on the transfer material, then it becomes likely that the toner adheres to the cutting edge of the transfer material (the edge of the paper sheet). The adhesion of toner like this may often occur on a leading edge and a trailing edge of a transfer material in a conveyance direction.

The toner that has adhered to the edge of a transfer material may not be easily fixed by a fixing unit. Accordingly, in this case, the phenomenon of offset may occur in the fixing unit. Furthermore, the toner adhering to the edge of the transfer material may contaminate a transfer material conveyance unit, which may result in a smear on a front or back surface of the transfer material.

In addition to the above-described image degradation, because the toner adhering to the edge of a transfer material may not be easily fixed, the toner adhering to the edge may be output unfixed and the unfixed toner then adheres to the hand of a user.

SUMMARY OF THE INVENTION

The present invention is directed to an image forming apparatus capable of suppressing the adhesion of toner to the edge of a transfer material, which may often occur in forming a marginless toner image on a transfer material.

According to an aspect of the present invention, an image forming apparatus includes an image bearing member configured to bear a toner image and move, a transfer member configured to form a nip with the image bearing member and move, and a control device configured to control a moving speed of the transfer member. In the image forming apparatus, a transfer material is conveyed through the nip and the toner image on the image bearing member is transferred on the transfer material. Furthermore, in the image forming apparatus, the image forming apparatus forms a toner image on the image bearing member from an area corresponding to the transfer material to an area corresponding to an outside of the transfer material and can perform a marginless mode for transferring the toner image on an edge of the transfer material. In addition, at least at a time of transferring the toner image onto a leading edge of the transfer material in a transfer material conveyance direction in the marginless mode, the control device controls the moving speed of the transfer member so that a conveyance speed of the transfer material at a time of entering the nip becomes slower than the moving speed of the image bearing member.

According to another aspect of the present invention, an image forming apparatus includes an image bearing member configured to bear a toner image and move, a transfer member configured to form a nip with the image bearing member and move, and a control device configured to control a moving speed of the transfer member. In the image forming apparatus, a transfer material is conveyed through the nip and the toner image on the image bearing member is transferred on the transfer material. Furthermore, the image forming apparatus forms a toner image on the image bearing member from an area corresponding to the transfer material to an area corresponding to an outside of the transfer material and can perform a marginless mode for transferring the toner image on an edge portion of the transfer material. In addition, at least at a time of transferring the toner image onto a trailing edge of the transfer material in a transfer material conveyance direction in the marginless mode, the control device is configured to control the moving speed of the transfer member so that a conveyance speed of the transfer material at a time of exiting the nip becomes faster than the moving speed of the image bearing member.

According to yet another aspect of the present invention, an image forming apparatus includes an image bearing member configured to bear a toner image and move, a transfer member configured to form a nip with the image bearing member and move, and a control device configured to control a moving speed of the transfer member. In the image forming apparatus, a transfer material is conveyed through the nip and the toner image on the image bearing member is transferred on the transfer material. Furthermore, the image forming apparatus forms a toner image on the image bearing member from an area corresponding to the transfer material to an area corresponding to an outside of the transfer material and can perform a marginless mode for transferring the toner image on an edge portion of the transfer material. In addition, at least at a time of transferring the toner image onto both a leading edge and a trailing edge of the transfer material in a transfer material conveyance direction in the marginless mode, the control device controls the moving speed of the transfer member so that a conveyance speed of the transfer material at a time of entering the nip becomes slower than the moving speed of the image bearing member and that the conveyance speed of the transfer material at the time of exiting the nip becomes faster than the moving speed of the image bearing member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to describe the principles of the present invention.

DETAILED DESCRIPTION OF THE EMBODIMENTS

Various exemplary embodiments, features, and aspects of the present invention will now be herein described in detail below with reference to the drawings. It is to be noted that the relative arrangement of the components, the numerical expressions, and numerical values set forth in these embodiments are not intended to limit the scope of the present invention.

Figure 1:
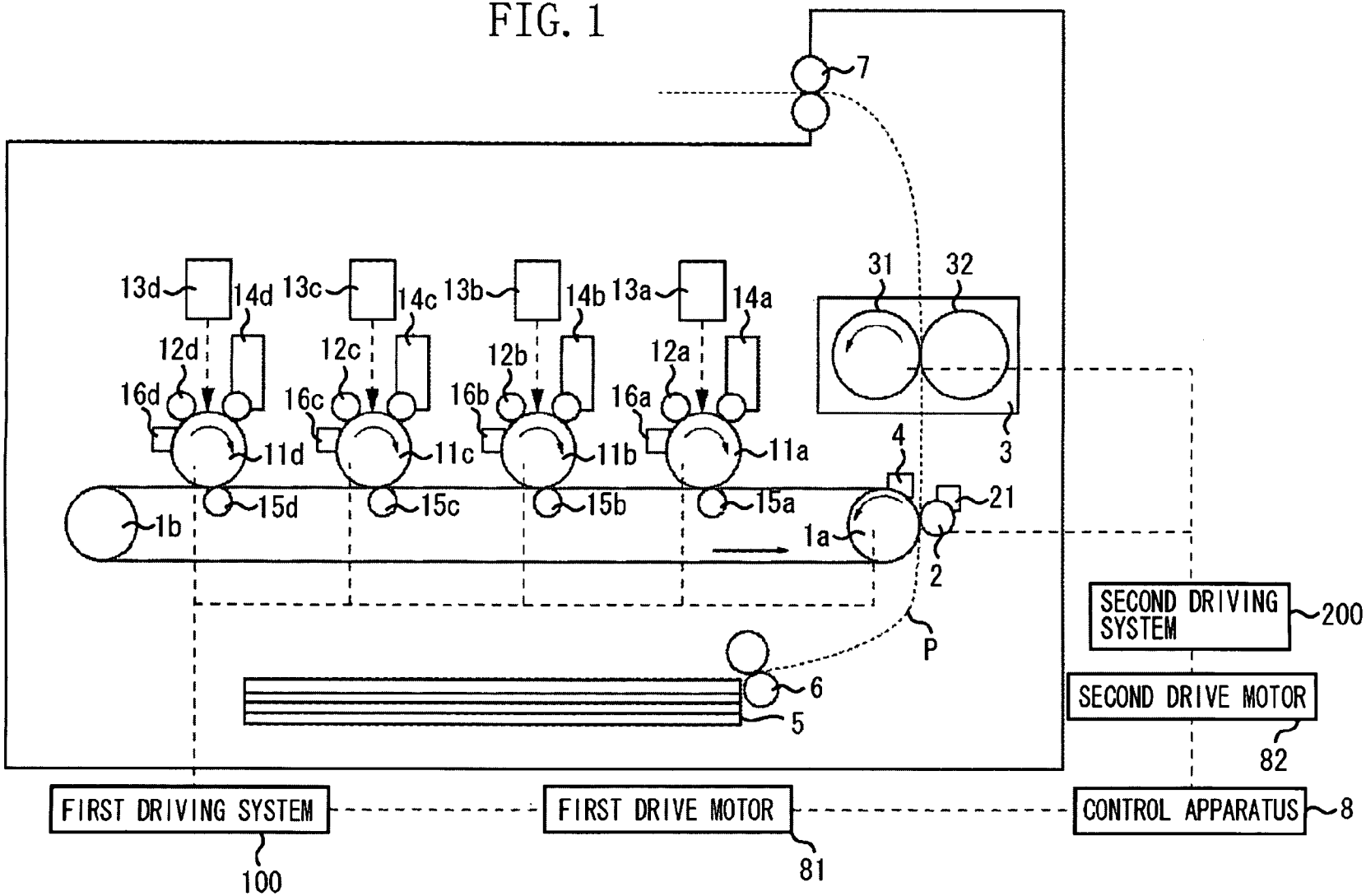
FIG. 1 illustrates an example of a configuration of the entire image forming apparatus according to a first exemplary embodiment of the present invention.

FIG. 1 is a cross section illustrating an exemplary configuration of the entire electrophotographic full color image forming apparatus according to a first exemplary embodiment of the present invention.

The image forming apparatus includes photosensitive members (image bearing members), which correspond to each of color toners such as a first color (yellow), a second color (magenta), a third color (cyan), and a fourth color (black). More specifically, the image forming apparatus includes a plurality of photosensitive drums 11*a*, 11*b*, 11*c*, and 11*d* as the photosensitive members.

Furthermore, the image forming apparatus includes an intermediate transfer belt (the intermediate transfer member) 1, which is the image bearing member capable of contacting each of the photosensitive drums 11*a*, 11*b*, 11*c*, and 11*d*.

The photosensitive drums 11*a*, 11*b*, 11*c*, and 11*d* are disposed in order of a first color photosensitive drum 11*a*, which is disposed most upstream of the four drums, a second color photosensitive drum 11*b*, a third color photosensitive drum 11*c*, and a fourth color photosensitive drum 11*d*.

The photosensitive drum 11*a*, 11*b*, 11*c*, and 11*d* each have the outer diameter of 30.0 mm and have a layer constituted by an aluminum cylinder coated with a photosensitive material.

As the intermediate transfer belt 1, a resin film, such as urethane resin, fluorine resin, nylon resin, or polyimide resin can be used. Furthermore, as the intermediate transfer belt 1, a resin film produced by applying carbon or conductive powders in a dispersed manner thereto that adjusts the resistance can be used.

Furthermore, as the intermediate transfer belt 1, an elastomer sheet can be used having a multiple layer structure in which a resin layer is formed as a release layer on the surface of a base layer sheet facing a toner bearing member. The base layer is made of a material such as urethane rubber or acrylonitrile-butadiene rubber (NBR).

The intermediate transfer belt 1 used in the present exemplary embodiment is adjusted to have a medium resistance of the surface resistance $\rho s=1\times10^{12}\Omega$ by dispersedly applying carbon polyimide thereto. With the intermediate transfer belt 1 having the adjusted resistance, the present exemplary embodiment can reduce the charge generated on the intermediate transfer belt 1 during transfer processing without particularly using a static eliminating mechanism. The intermediate transfer belt 1 is a single layer endless belt having a perimeter of 1,000 mm and a thickness of 100 μm.

A surface resistance was measured in compliance with Japanese Industrial Standards (JIS)-K6911. Furthermore, the measurement was conducted at a high contact efficiency between the electrode and the surface of the intermediate transfer belt 1 by using conductive rubber as the electrode. In addition, an ultra high resistance meter (R8340 of ADVANTEST CORPORATION) was used in the measurement.

The measurement was conducted by applying voltage of 100 V for 30 seconds.

The intermediate transfer belt 1 is suspended around two rollers, namely, a driving roller 1*a* and a driven roller 1*b* illustrated in FIG. 1, which are disposed inside the intermediate transfer belt 1. The driving roller 1*a* and the driven roller 1*b* are electrically grounded.

The driving roller 1*a* has an outer diameter of 29.8 mm and is constituted by an aluminum core having a diameter of 24.0 mm and a rubber layer 2.9 mm thick. Epichlorohydrin rubber is used as the rubber layer, in which the resistance is adjusted. Thus, the roller resistance of $1\times10^{6}\Omega$ is achieved.

The resistance value of the driving roller 1*a* was measured by using a digital ultra high resistance meter/microcurrent ammeter (R8340 of ADVANTEST CORPORATION) while the measurement target roller was contacting an aluminum cylinder having a diameter of 30 mm and was driven by the aluminum cylinder.

The measurement was conducted under the conditions of the voltage of 100 V, which was applied, for 30 seconds, the contacting force of 9.8 N, and the peripheral rotation speed of 117 mm/s.

The driven roller 1*b* is an aluminum roller having the same diameter as that of the driving roller 1*a* (29.8 mm).

In the example illustrated in FIG. 1, the intermediate transfer belt 1 is rotated by a first driving system 100 in a direction indicated by an arrow at a predetermined process speed (117.0 mm/s in the present exemplary embodiment).

Furthermore, each of the photosensitive drums 11*a*, 11*b*, 11*c*, and 11*d* is rotated by the first driving system 100 in the same direction as the rotational direction of the intermediate transfer belt 1 at a predetermined process speed (117.0 mm/s in the present exemplary embodiment).

The first driving system 100 is driven by a first driving motor 81. The rotational speed of the first driving motor 81 is controlled by a control device 8.

Each of the photosensitive drums 11*a*, 11*b*, 11*c*, and 11*d*, is evenly charged by each of contact charging rollers 12*a*, 12*b*, 12*c*, and 12*d*. On the surface of the photosensitive drums 11*a*, 11*b*, 11*c*, and 11*d*, an electrostatic latent image is formed with a laser beam emitted from scanners 13*a*, 13*b*, 13*c*, and 13*d*, which have been modulated by an exposure information signal.

An image information signal transmitted from a host computer (not illustrated) is processed by a controller (not illustrated) to have a desired size and is converted into the exposure information signal.

The intensity of the laser beam and the irradiation spot diameter are appropriately set according to the resolution of the image forming apparatus and a desired image density.

The electrostatic latent image is formed on the surface of the photosensitive drums 11*a*, 11*b*, 11*c*, and 11*d* in the following manner. The potential of the electrostatic latent image where irradiated with the laser beam, is kept at a bright portion potential VL (approximately −150 V). On the other hand, the potential of the other portion of the electrostatic latent image is kept at a dark portion potential VD (approximately −650 V), which is charged by the contacting charging rollers 12*a*, 12*b*, 12*c*, and 12*d* (primary chargers).

When the electrostatic latent image, conveyed by rotation of each of the photosensitive drums 11*a*, 11*b*, 11*c*, and 11*d*, reaches a portion facing development units 14*a*, 14*b*, 14*c*, and 14*d*, a developer (toner) that has been electrostatically charged with the same polarity as that of the surface of the photosensitive drum (the negative polarity in the present exemplary embodiment) is supplied. Thus, the electrostatic latent image is visualized.

The development unit 14 is a development device employing a dual-component development method. With respect to the development bias, the DC component was set at −400 V, the AC component was set at 1.5 kVpp, the frequency was 3 kHz, and the waveform was a square wave in which direct voltage is overlapped with alternating voltage. Primary transfer rollers 15*a*, 15*b*, 15*c*, 15*d* are disposed on a back surface of the intermediate transfer belt 1 and at a position opposing each of the photosensitive drums 11*a*, 11*b*, 11*c*, and 11*d*.

A primary transfer nip is formed between the primary transfer rollers 15*a*, 15*b*, 15*c* and 15*d*, and the photosensitive drums 11*a*, 11*b*, 11*c* and 11*d* via the intermediate transfer belt 1.

The toner image formed on each of the photosensitive drums 11*a*, 11*b*, 11*c*, and 11*d* is transferred to the intermediate transfer belt 1 at the primary transfer nip formed at the proximity of or at the portion contacting the photosensitive drums 11*a*, 11*b*, 11*c*, and 11*d*.

A primary transfer bias (in the present exemplary embodiment, a constant voltage control of +400V) is applied from the primary transfer bias source to the primary transfer rollers 15*a*, 15*b*, 15*c*, and 15*d*, which is contacting a back surface of the intermediate transfer belt 1 (not illustrated). The toner image is transferred onto the intermediate transfer belt 1 with the primary transfer bias (the intermediate transfer belt 1 receives the transferred toner image).

When the intermediate transfer belt 1 passes through the primary transfer nip formed together with the photosensitive drum 11*d*, forming of the four-color image on the intermediate transfer belt 1 is finished. Thus, the primary transfer processing is completed.

On the other hand, after having primarily transferred the toner image, the surface of the photosensitive drums 11*a*, 11*b*, 11*c*, and 11*d* is cleaned up by each of drum cleaning devices 16*a*, 16*b*, 16*c*, and 16*d*. The drum cleaning devices are constituted by urethane rubber blades, which remove the primary transfer residual toner to make the photosensitive drums ready for subsequent image forming processing.

A secondary transfer roller 2 is disposed on the downstream side of each primary transfer nip in a conveyance direction, opposed to the intermediate transfer belt 1. The secondary transfer roller 2 is a transfer member that forms a nip against the intermediate transfer belt (image bearing member) 1 and moves around a core. More specifically, the secondary transfer roller (transfer member) 2 is a roller that rotates around a shaft.

The driving roller la is disposed on the back surface of the intermediate transfer belt 1 and at a position opposing the secondary transfer roller 2.

When the primary transfer processing on the intermediate transfer belt 1 is completed, one sheet of transfer material P is fed by a paper feed unit 6 from a transfer material cassette 5. The transfer material P is fed to be inserted into a secondary transfer nip between the driving roller 1*a* and the secondary transfer roller 2 across the intermediate transfer belt 1.

At this time, an optimum bias having a reversed polarity against the charging polarity of the toner is applied to the secondary transfer roller 2. The optimum bias is determined according to the temperature and the humidity within the image forming apparatus, which is detected by a temperature and humidity sensor. Thus, the toner image is secondary-transferred from the intermediate transfer belt 1 onto the transfer material P.

More specifically, the constant current control is performed so that +20 μA at 15° C./10% relative humidity (RH), +30 μA at 23° C./50% RH, and +35 μA at 30° C./80% RH is applied to the secondary transfer roller 2 by a secondary transfer bias source (not illustrated). Here, the secondary transfer roller 2 according to the present exemplary embodiment is a single layer sponge roller having an outer diameter of 15.0 mm and constituted by an aluminum core having a diameter of 9.0 mm and an expanded rubber layer 3 mm thick.

The material for the secondary transfer roller 2 is made of a mixture of NBR and epichlorohydrin rubber combined with an antioxidant. The resistance value of the secondary transfer roller 2 is adjusted to $1\times10^8\Omega$ by using the above-described material. In addition, the rigidity of the secondary transfer roller 2 is set at 35° (ASKER-C).

The resistance value of the secondary transfer roller 2 was measured while the secondary transfer roller 2 was contacting an aluminum cylinder having a diameter of 30 mm and driven around the aluminum cylinder by using an ultra high resistance meter (R8340 of ADVANTEST CORPORATION) under measurement conditions of the voltage of 100 V which was applied, for 30 seconds, the contacting force of 9.8 N, and the peripheral rotation speed of 117 mm/s.

The secondary transfer roller 2 is driven by a second driving system 200 to rotate in a direction indicated by an arrow in FIG. 1.

The second driving system 200 is driven by a second driving motor 82. The rotational speed of the second driving motor 82 is controlled by the control device 8.

More specifically, the control device 8 is a control device that controls the rotational speed of the secondary transfer roller 2, which is the transfer member.

Furthermore, the control device 8 separately and independently controls the rotational speed of the first driving motor 81, which drives the intermediate transfer belt 1, and the second driving motor 82, which drives the secondary transfer roller 2.

After the toner image has been secondary-transferred from the intermediate transfer belt 1 onto the transfer material P, the residual toner on the surface of the secondary transfer roller 2 is cleaned by a secondary transfer roller cleaner 21, which has a cleaning blade made of urethane rubber. Thus, the toner is prevented from adhering to the back surface of the transfer material P after one rotation of the secondary transfer roller 2.

The transfer material P having the unfixed toner image after passing through the secondary transfer nip then reaches a fixing device 3. Then, the fixing device 3 applies heat and pressure to obtain a fixed image.

The fixing device 3 is constituted by a heating roller 31 and a pressure roller 32. The heating roller (fixing roller) 31 is driven by the second driving system 200.

After being discharged from the fixing device 3, the transfer material P is conveyed by a conveyance unit 7 to an outside of the image forming apparatus.

After completely transferring the toner image onto the transfer material P, the surface of the intermediate transfer belt 1 is cleaned by an intermediate transfer member cleaner 4 having a cleaning blade made of urethane rubber.

Now, an image forming mode according to the present exemplary embodiment will be described in detail below.

The image forming apparatus according to the present exemplary embodiment can execute image forming processing in either a normal mode or a marginless mode. The normal mode is a mode for forming an image with a margin around the entire peripheral edge of the transfer material. The marginless mode is a mode for forming an image on the entire portion of the transfer material up to the edge thereof, without leaving a margin.

More specifically, the marginless mode is a mode for transferring a toner image up to the edges of the transfer material. The toner image is formed on the surface of the intermediate transfer belt (image bearing member) 1 from an area equivalent to the entire transfer material to the area outside the transfer material.

Figure 2A:
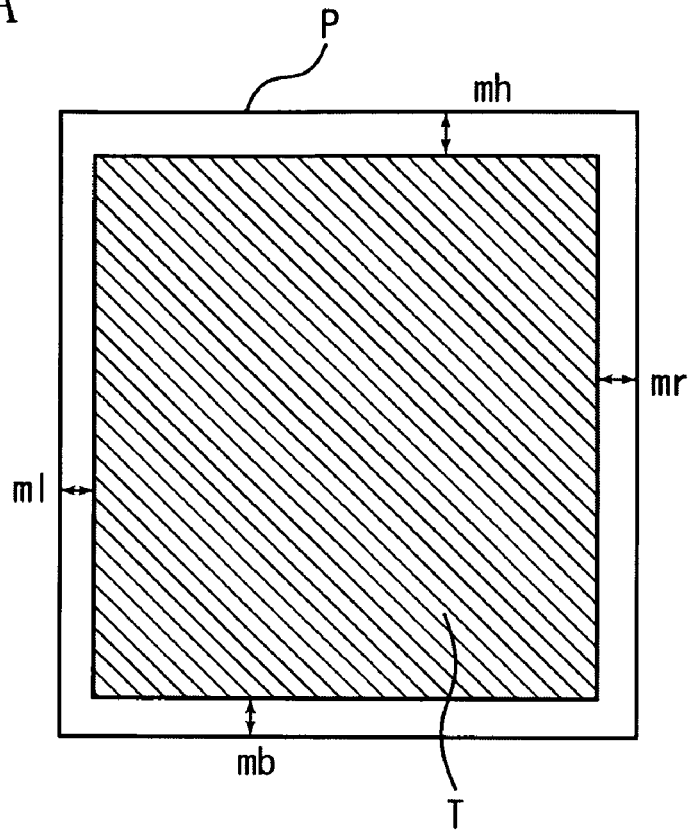
FIGS. 2A and 2B respectively illustrate an example of a normal mode and a marginless mode according to an exemplary embodiment of the present invention.
Figure 2B:
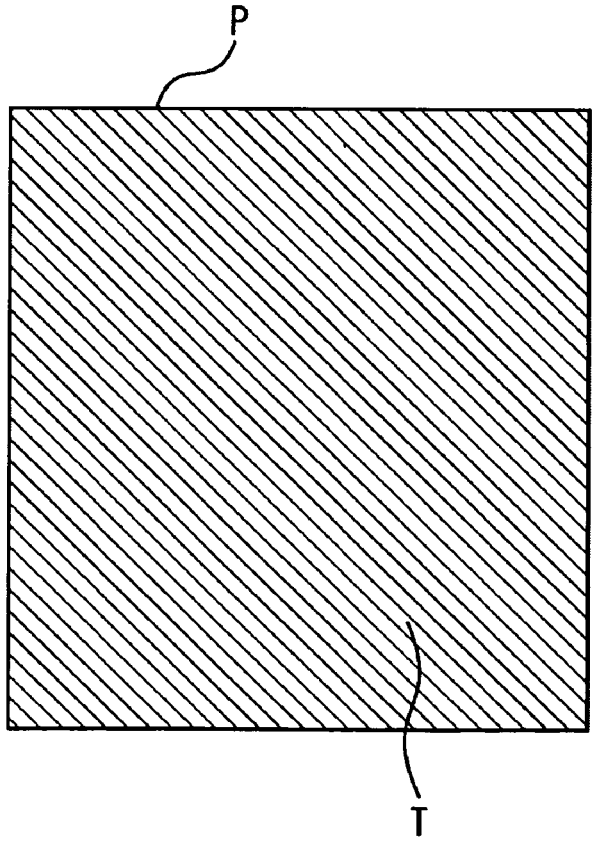

FIG. 2A illustrates the normal mode according to the present exemplary embodiment, while FIG. 2B illustrates the marginless mode according to the present exemplary embodiment.

In the normal mode, the entire toner image T is formed within transfer material P. In this case, the transfer material P has peripheral margins, i.e., a head margin (mh), a bottom margin (mb), a left margin (ml), and a right margin (mr).

On the other hand, in the marginless mode, the toner image T is formed in the entire area of the transfer material P to its edge, without leaving the peripheral margin.

In the example illustrated in FIG. 2B, top, bottom, left, and right margins are all omitted. However, the present invention is not limited to this embodiment. More specifically, the marginless mode in which either of or several of the top, bottom, left, and right margins are omitted can also be implemented.

In the normal mode, the setting is made so that the conveyance speeds of the transfer material P and the moving speed of the intermediate transfer belt (image bearing member) 1 at the secondary transfer nip become substantially the same while the transfer material P passes through the secondary transfer nip. More specifically, the control device 8 controls the rotational speed of the secondary transfer roller 2 so that the conveyance speeds of the transfer material P and the intermediate transfer belt (image bearing member) 1 at the secondary transfer nip become substantially the same.

By performing the above-described control under which the conveyance speeds of the transfer material P and the intermediate transfer belt (image bearing member) 1 are substantially the same, the present exemplary embodiment can prevent the transfer unevenness from appearing at the secondary transfer nip.

Now, the marginless mode according to the present exemplary embodiment will be described in detail below. At least at the time of transferring the toner image onto a leading edge of the transfer material P in the conveyance direction, in the marginless mode, the control device 8 controls the rotational speed of the secondary transfer roller 2 so that the conveyance speed of the transfer material P at the time of entering the secondary transfer nip becomes slower than the moving speed of the intermediate transfer belt 1.

More specifically, the rotational speed of the secondary transfer roller 2 at the secondary transfer nip is set at the speed slower than the moving speed of the intermediate transfer belt 1.

Furthermore, at least at the time of transferring the toner image onto the edge in a trailing edge of the transfer material P in the conveyance direction, in the marginless mode, the control device 8 controls the rotational speed of the secondary transfer roller 2 so that the conveyance speed of the transfer material P at the time of entering the secondary transfer nip becomes faster than the moving speed of the intermediate transfer belt 1.

More specifically, in this case, the control device 8 performs the control so that the rotational speed of the secondary transfer roller 2 at the secondary transfer nip becomes faster than the moving speed of the intermediate transfer belt 1.

With the above-described configuration, the present exemplary embodiment can prevent the toner from adhering to the edge portions on the leading edge or the trailing edge of the transfer material P in the conveyance direction.

A mechanism according to the present exemplary embodiment for implementing the above-described configuration will be described in detail below.

To begin with, the relationship between the moving speeds of the secondary transfer roller 2 and the intermediate transfer belt 1, and the conveyance speed of the transfer material P will be described below.

Figure 3:
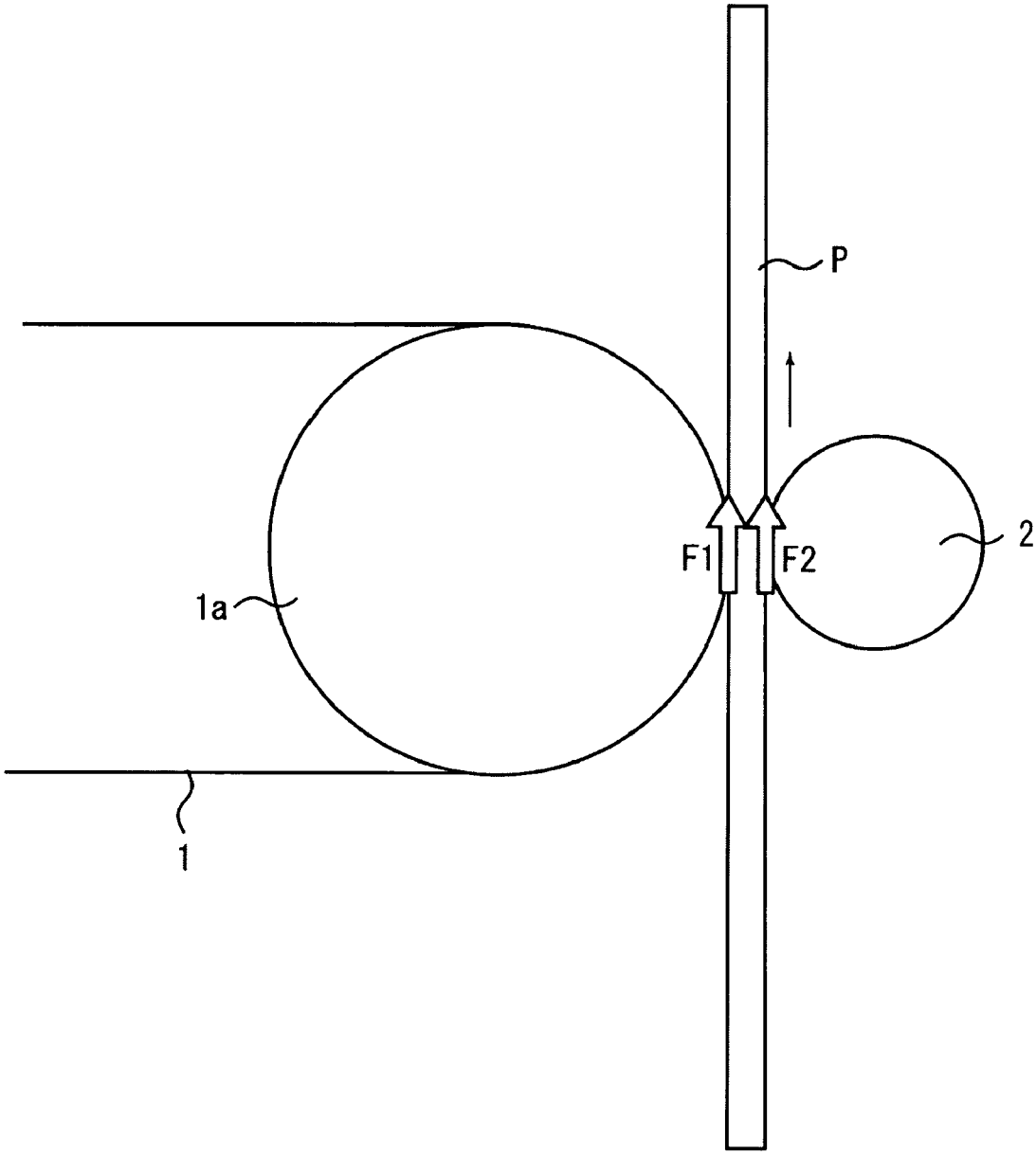
FIG. 3 illustrates a transfer material conveyance force according to an exemplary embodiment of the present invention.

FIG. 3 illustrates the conveyance force applied on the transfer material P at the time the transfer material P reaches the secondary transfer nip.

The conveyance force applied on the transfer material P is determined based on a frictional force F1 between the front surface of the intermediate transfer belt 1 and the front surface of the transfer material P and a frictional force F2 between the back surface of the secondary transfer roller 2 and the back surface of the transfer material P.

Figure 4:
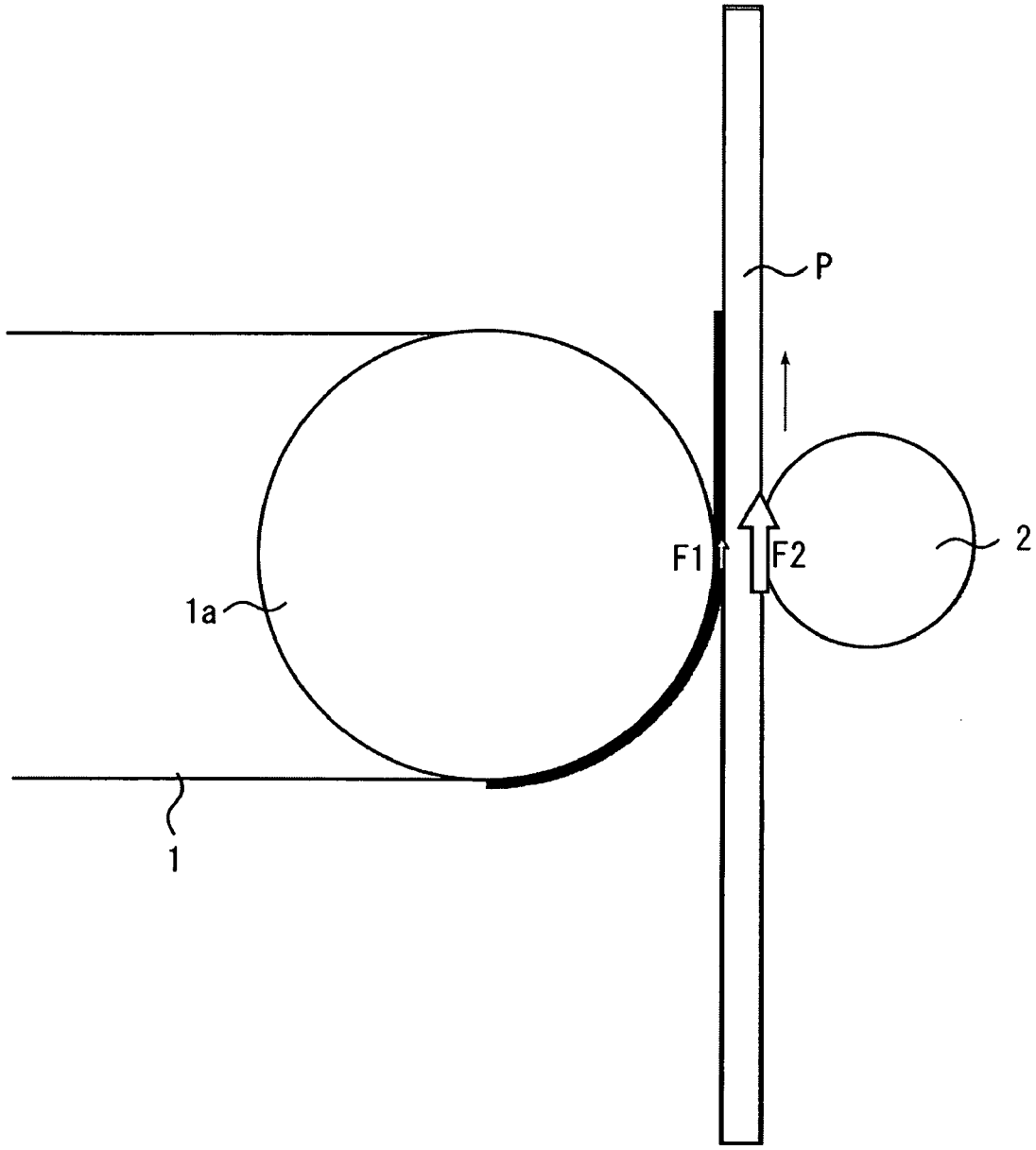
FIG. 4 illustrates a transfer material conveyance force according to an exemplary embodiment of the present invention.

FIG. 4 illustrates the frictional force on the transfer material P applied thereon when the transfer material P is nipped in the secondary transfer nip. In FIG. 4, the toner image T has been formed on the front surface of the intermediate transfer belt 1 (i.e., the toner image T is secondary-transferred from the intermediate transfer belt 1 on the transfer material P).

In the case where the toner image T has been formed on the surface of the intermediate transfer belt 1, the frictional force F1 becomes small due to the toner that serves as a kind of a lubricant. Accordingly, the frictional force F2 becomes dominant with respect to the conveyance force on the transfer material P.

More specifically, in the case where the toner image T is formed on the surface of the intermediate transfer belt 1 and the toner image is transferred on the transfer material P from the intermediate transfer belt 1, the conveyance speed of the transfer material P is determined based on the rotational speed of the secondary transfer roller 2. Accordingly, in the case where the rotational speed of the secondary transfer roller 2 is set faster than the moving speed of the intermediate transfer belt 1, the conveyance speed of the transfer material P becomes faster. On the other hand, in the case where the rotational speed of the secondary transfer roller 2 is set slower than the moving speed of the intermediate transfer belt 1, the conveyance speed of the transfer material P becomes slower.

Now, the state of secondary transfer nip in the marginless mode will be described in detail below.

Figure 5:
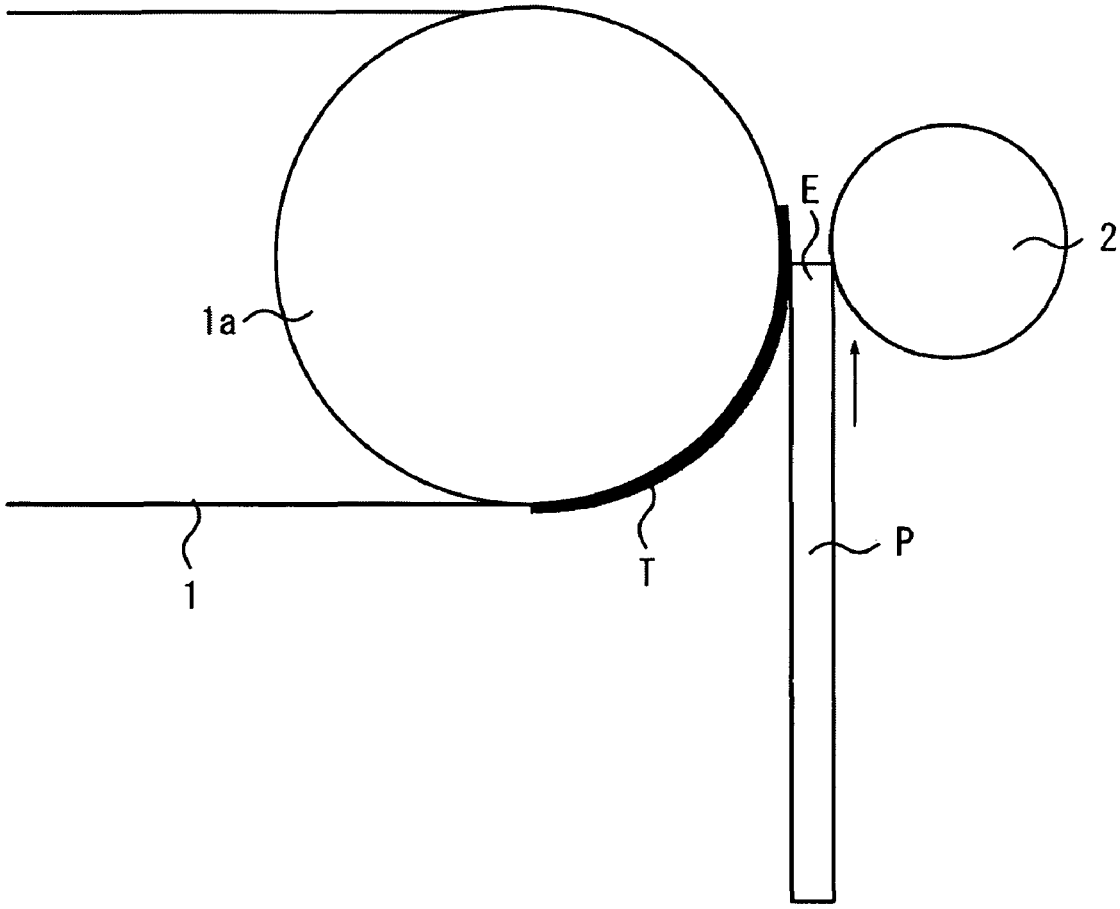
FIG. 5 illustrates the state of a leading edge of a transfer material in the marginless mode according to an exemplary embodiment of the present invention.

FIG. 5 illustrates the state immediately after the transfer material P has entered the secondary transfer nip, at least at the time of transferring the toner image onto the leading edge of the transfer material P in the conveyance direction, in the marginless mode.

Referring to FIG. 5, the toner image born by the intermediate transfer belt 1 enters the secondary transfer nip earlier than the transfer material P.

If the conveyance speed of the transfer material P is set faster than the moving speed of the intermediate transfer belt 1 at the time of transferring the toner image onto the leading edge of the transfer material P in the conveyance direction, the toner image on the intermediate transfer belt 1 is pressed by a leading edge E of the transfer material P. Thus, in this case, it becomes extremely likely that the toner adheres to the leading edge E of the transfer material P in the conveyance direction.

On the other hand, according to the present exemplary embodiment, the control device 8 controls the rotational speed of the secondary transfer roller 2 so that the conveyance speed of the transfer material P may becomes slower than the moving speed of the intermediate transfer belt 1 at least at the time of transferring the toner image onto the leading edge of the transfer material P in the conveyance direction.

By performing the control with the control device 8, the present exemplary embodiment can prevent the leading edge E of the transfer material P from pressing the toner image T to the intermediate transfer belt 1, which may otherwise occur.

If the conveyance speed of the transfer material P at the time of entering the secondary transfer nip is set slower than the moving speed of the intermediate transfer belt 1, the edge of the transfer material P may become separated from (may not contact) the toner image.

Therefore, the control device 8 according to the present exemplary embodiment performs the control under which the conveyance speed of the transfer material P becomes slower than the moving speed of the surface of the intermediate transfer belt 1 at least at the time of transferring the toner image on the leading edge of the transfer material P in the conveyance direction.

Figure 6:
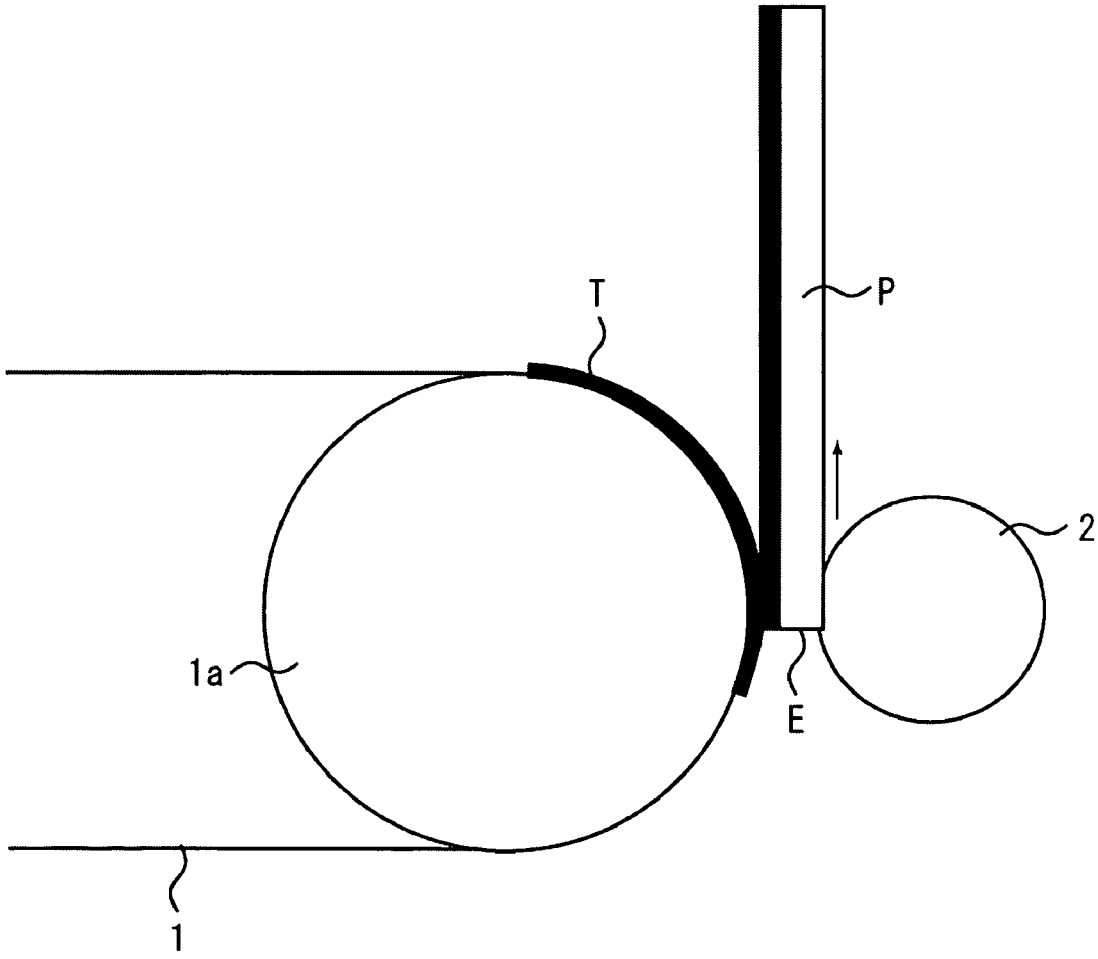
FIG. 6 illustrates the state of a trailing edge of a transfer material in the marginless mode according to an exemplary embodiment of the present invention.

FIG. 6 illustrates the state in which the transfer material P exits the secondary transfer nip at least at the time of transferring the toner image onto the trailing edge of the transfer material P in the conveyance direction.

Referring to FIG. 6, the toner image born by the intermediate transfer belt 1 enters the secondary transfer nip after the transfer material P.

If the conveyance speed of the transfer material P is set slower than the moving speed of the intermediate transfer belt 1 at least at the time of transferring the toner image onto the trailing edge of the transfer material P in the conveyance direction, the trailing edge E of the transfer material P is pressed against the toner image on the intermediate transfer belt 1. Furthermore, if the relationship between the conveyance speed of the transfer material P and the moving speed of the intermediate transfer belt 1 is not appropriate, the trailing edge E of the transfer material P may stem the toner image in the area corresponding to the outside of the trailing edge of the transfer material P born by the intermediate transfer belt 1. As a result, it may become extremely likely that the toner adheres to the trailing edge E of the transfer material P in the conveyance direction.

However, according to the present exemplary embodiment, the control device 8 controls the rotational speed of the secondary transfer roller 2 so that the conveyance speed of the transfer material P becomes faster than the moving speed of the intermediate transfer belt 1 at the time the transfer material P exits the secondary transfer nip at least at the time of transferring the toner image onto the trailing edge of the transfer material P in the conveyance direction.

By performing the above-described control with the control device 8, the present exemplary embodiment can prevent the trailing edge E of the transfer material P from stemming the toner image T on the intermediate transfer belt 1.

If the conveyance speed of the transfer material P is faster than the moving speed of the surface of the intermediate transfer belt 1, then the trailing edge E of the transfer material P does not contact the toner image on the intermediate transfer belt 1.

In the following case, the toner image is at least transferred on both the leading edge and the trailing edge of the transfer material P in the conveyance direction during the marginless mode. For example, the case where the image is formed on the entire transfer material P up to the edge thereof without setting a margin in the marginless mode will be described below.

In this case, as described above, the conveyance speed of the transfer material P is adjusted at the time of entering the secondary transfer nip to be slower than the moving speed of the intermediate transfer belt 1.

In this situation, if the transfer material P exits the secondary transfer nip at the above-described conveyance speed, which is slower than the moving speed of the intermediate transfer belt 1, the toner is pressed against the trailing edge of the transfer material P.

Accordingly, the present exemplary embodiment changes the conveyance speed of the transfer material P with respect to the moving speed of the intermediate transfer belt 1 after the leading edge of the transfer material P enters the secondary transfer nip and before the trailing edge of the transfer material P exits the secondary transfer nip. More specifically, the present exemplary embodiment performs the control so that the conveyance speed of the transfer material P at the time of exiting the secondary transfer nip becomes faster than that at the time of entering the secondary transfer nip.

As described above, the first driving system 100, which drives each of the photosensitive drums 11*a*, 11*b*, 11*c*, and 11*d* and the intermediate transfer belt 1, and the second driving system 200, which drives the secondary transfer roller 2 and the heating roller 31, are driven by the first driving motor 81 and the second driving motor 82, respectively. The rotational speed of each of the first driving motor 81 and the second driving motor 82 is separately and independently controlled by the control device 8.

In the present exemplary embodiment, a pulse motor is used as the driving motor to enable changing of the rotational speeds of the first driving motor 81 and the second driving motor 82. The changing of the rotational speeds of the first driving motor 81 and the second driving motor 82 is implemented by changing the driving pulse from the control device 8.

More specifically, the present exemplary embodiment changes the conveyance speed of the transfer material P relative to the intermediate transfer belt 1 at the secondary transfer nip, by controlling the rotational speed of the secondary transfer roller 2 with the control device 8.

Figure 7:
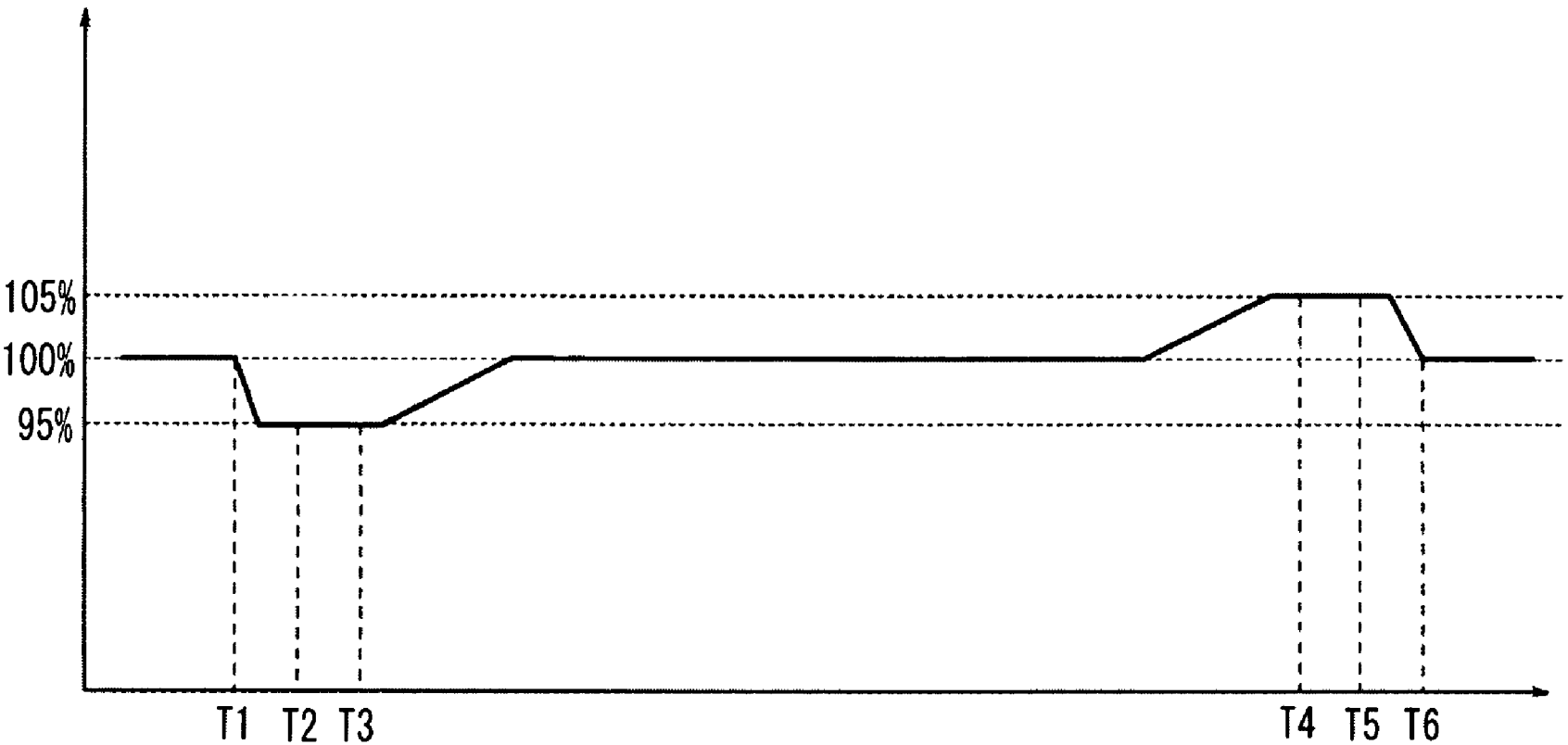
FIG. 7 illustrates an exemplary control executed in the marginless mode according to an exemplary embodiment of the present invention.

FIG. 7 illustrates the change of the rotational speed of the secondary transfer roller 2 from the time the transfer material P enters the secondary transfer nip and to the time the transfer material P exits the secondary transfer nip. In the example illustrated in FIG. 7, the time is represented by the horizontal axis and the ratio of the rotational speed of the secondary transfer roller 2 to the rotational speed of the intermediate transfer belt driving roller 1*a* is represented by the vertical axis.

In FIG. 7, if the rotational speed ratio is 100%, the rotational speed of the secondary transfer roller 2 and that of the driving roller 1*a* is the same. If the rotational speed ratio is 95%, the secondary transfer roller 2 is rotated at the speed slower than that of the driving roller 1*a*. If the rotational speed ratio is 105%, the secondary transfer roller 2 is rotated at the speed faster than that of the driving roller 1*a*.

In an initial state (before a time T1), the rotational speed ratio is 100%. The control device 8 decreases the rotational speed of the secondary transfer roller 2 before the transfer material P enters the secondary transfer nip. More specifically, the control device 8 changes the rotational speed ratio to 95% after the time T1 and before a time T2.

The time T2 is the timing at which the leading edge of the transfer material P enters the secondary transfer nip. The time T3 is the timing at which the leading edge of the transfer material P exits the secondary transfer nip.

As illustrated in FIG. 7, the present exemplary embodiment performs the control so that the rotational speed of the secondary transfer roller 2 is kept slower than the moving speed of the intermediate transfer belt 1 while the leading edge of the transfer material P is at the secondary transfer nip.

After the leading edge of the transfer material P exits the secondary transfer nip, the control device 8 sets the rotational speed ratio at 100% again. After the transfer material P is further conveyed and before the trailing edge of the transfer material P exits the secondary transfer nip, the control device 8 increases the rotational speed ratio to 105%.

A time T4 is the timing at which the trailing edge of the transfer material P enters the secondary transfer nip. A time T5 is the timing at which the trailing edge of the transfer material P exits the secondary transfer nip.

As illustrated in FIG. 7, the present exemplary embodiment performs the control so that the rotational speed of the secondary transfer roller 2 is kept faster than the moving speed of the intermediate transfer belt 1 while the trailing edge of the transfer material P is at the secondary transfer nip. The control device 8 sets the rotational speed ratio to be 100% again at a predetermined timing a while after the trailing edge of the transfer material P exits the secondary transfer nip.

As described above, the control device 8 increases the rotational speed of the secondary transfer roller 2 by 5% from the initial rotational speed ratio (100%) relative to the leading edge of the transfer material P while the control device 8 decreases the rotational speed of the secondary transfer roller 2 by 5% from the initial rotational speed ratio (100%) relative to the trailing edge of the transfer material P.

Whether the rotational speed ration is 100% can be easily determined by measuring an image elongation ratio. The image elongation ratio can be measured by the following method.

At first, thin lateral lines, which are used for the measurement, are drawn on the intermediate transfer belt 1. Then, an image of the drawn thin lateral lines is transferred on the surface of an adhesive tape, which has a small elongation ratio. This measurement preparation operation should be performed on the flat portion of the intermediate transfer belt 1, not on the round portion thereof.

Then, the image is normally output on a normal transfer material P. Then, the interval between the thin lateral lines transferred on the adhesive tape and that output on the transfer material P are compared to verify if they are the same.

In the present exemplary embodiment, the comparison was conducted by drawing 0.1 mm-wide lateral lines with constant intervals of 9.9 mm. An approximately 100 to 200 mm-long image of the lines was transferred on an adhesive tape. With respect to the adhesive tape, a polyethylene terephthalate (PET) tape (polyester tape NO. 550 (#25) of NICHIBAN CO., LTD.) was used. The lengths of eleven or twenty-one transferred lateral lines were measured and were used as reference lengths.

Then, the image of the lateral lines was output while changing the rotational speed of the secondary transfer roller 2. Then, the image of the lateral lines was compared with the reference length. The rotational speed of the secondary transfer roller 2 at which a length of the lateral lines was the same as the reference length, was determined to be 100% of the rotational speed ratio.

As described above, in the present exemplary embodiment, the secondary transfer roller 2 is rotated slower by −5% on the leading edge of the transfer material P than the rotational speed of the secondary transfer roller 2 that is the rotational speed ratio 100%. On the other hand, the secondary transfer roller 2 is rotated faster by +5% on the trailing edge of the transfer material P than the rotational speed of the secondary transfer roller 2.

Figure 8:
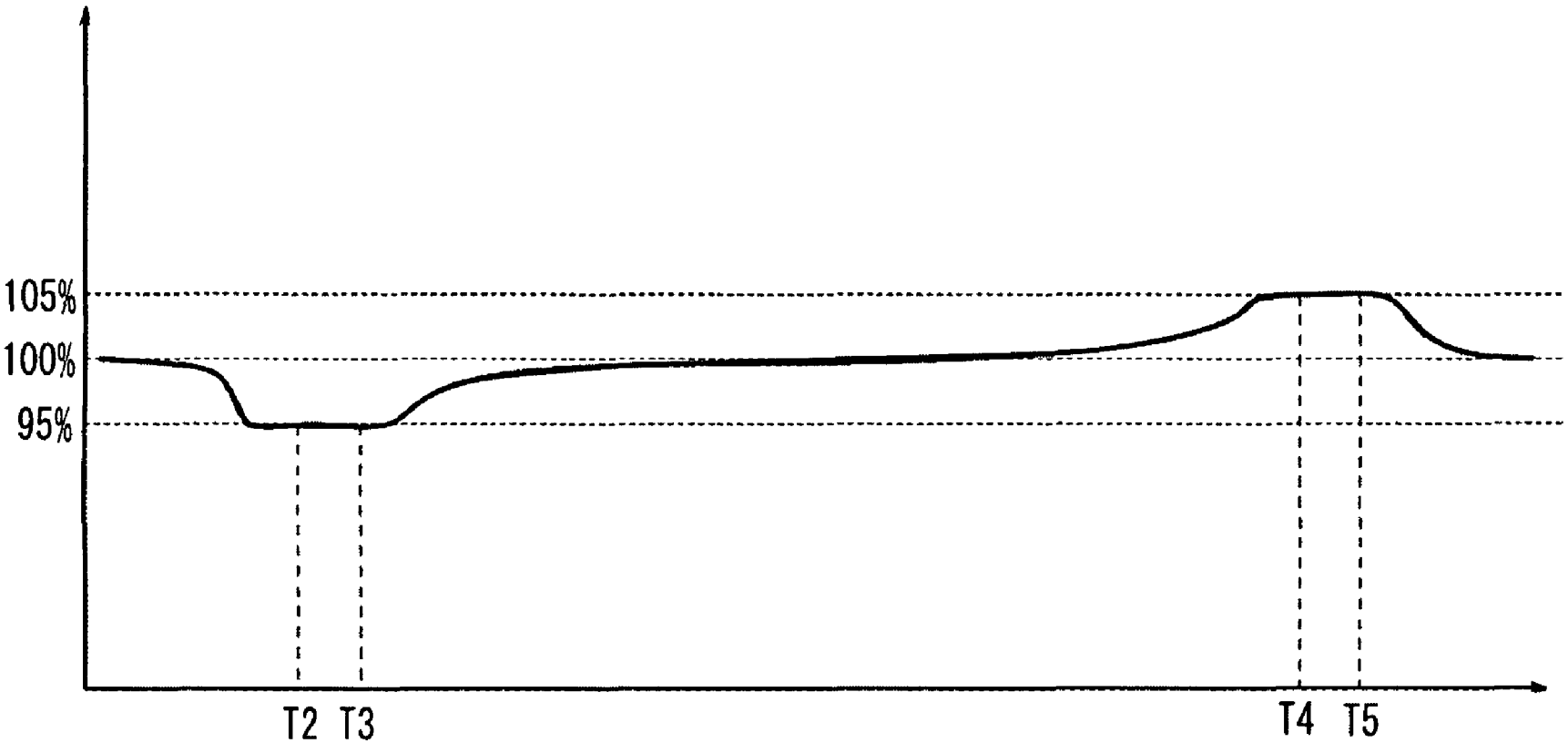
FIG. 8 illustrates an exemplary control executed in the marginless mode according to an exemplary embodiment of the present invention.

In the present exemplary embodiment, the rotational speed of the roller is linearly changed by increasing or decreasing the speed by 5% from the reference speed. However, the present invention is not limited to this embodiment. More specifically, the rotational speed of the roller can be more smoothly changed as illustrated in FIG. 8. However, in order to suppress or at least reduce the toner adhering to the edge of the transfer material P, it is also useful to perform the control for surely decreasing the rotational speed during the time period between the time T2 and the time T3 and increasing the rotational speed during the time period between the time T4 and the time T5.

In the present exemplary embodiment, the rotational speed is increased or decreased by 5%. However, the present invention is not limited to this embodiment. More specifically, ratio difference greater or smaller than 5% can also be used in changing the rotational speed ratio.

However, in the case where the secondary transfer roller 2 is used as the secondary transfer material, the transfer material P is not attracted to the secondary transfer roller 2. Accordingly, the conveyance speed of the transfer material P is set slightly slower than the moving speed of the surface of the secondary transfer roller 2. Therefore, in order to surely set the conveyance speed of the transfer material P to be slower than the moving speed of the surface of the intermediate transfer belt 1, it is useful to change the rotational speed of the secondary transfer roller 2 by equal to or more than 2% because an appropriate range of change of rotational speed is necessary.

Furthermore, if the rotational speed is increased or decreased by 10%, the image may be too much elongated or contracted at the leading edge or the trailing edge. Accordingly, it is useful to set the range of the rotational speed change to be smaller than 10%.

With the above-described configuration, the present exemplary embodiment can suppress or at least reduce the adhesion of the toner to the transfer material P in the leading edge and the trailing edge by setting the rotational speed of the secondary transfer roller 2 at the leading edge of the transfer material P to be slower than the reference rotational speed.

Furthermore, the present exemplary embodiment can suppress or at least reduce the adhesion of the toner to the edge portion of the transfer material P by setting the rotational speed of the secondary transfer roller 2 to be faster than the reference rotational speed at the trailing edge of the transfer material P. Thus, the present exemplary embodiment can suppress or at least reduce the image degradation that may occur due to an offset at the fixing unit or the smear in the paper conveyance unit.

Now, a second exemplary embodiment of the present invention will be described in detail below.

In the first exemplary embodiment, the secondary transfer roller 2 is used as the transfer member. The rotational speed of the secondary transfer roller 2 is set to be slower than the reference rotational speed at the leading edge of the transfer material P. On the other hand, the rotational speed of the secondary transfer roller 2 is set to be faster than the reference rotational speed at the trailing edge of the transfer material P. Thus, the first exemplary embodiment suppresses or reduces the toner adhering to the edge portion of the transfer material P.

The second exemplary embodiment of the present invention implements the above-described method according to the first exemplary embodiment even in the case where an asymmetric toner image is output.

Figure 9:
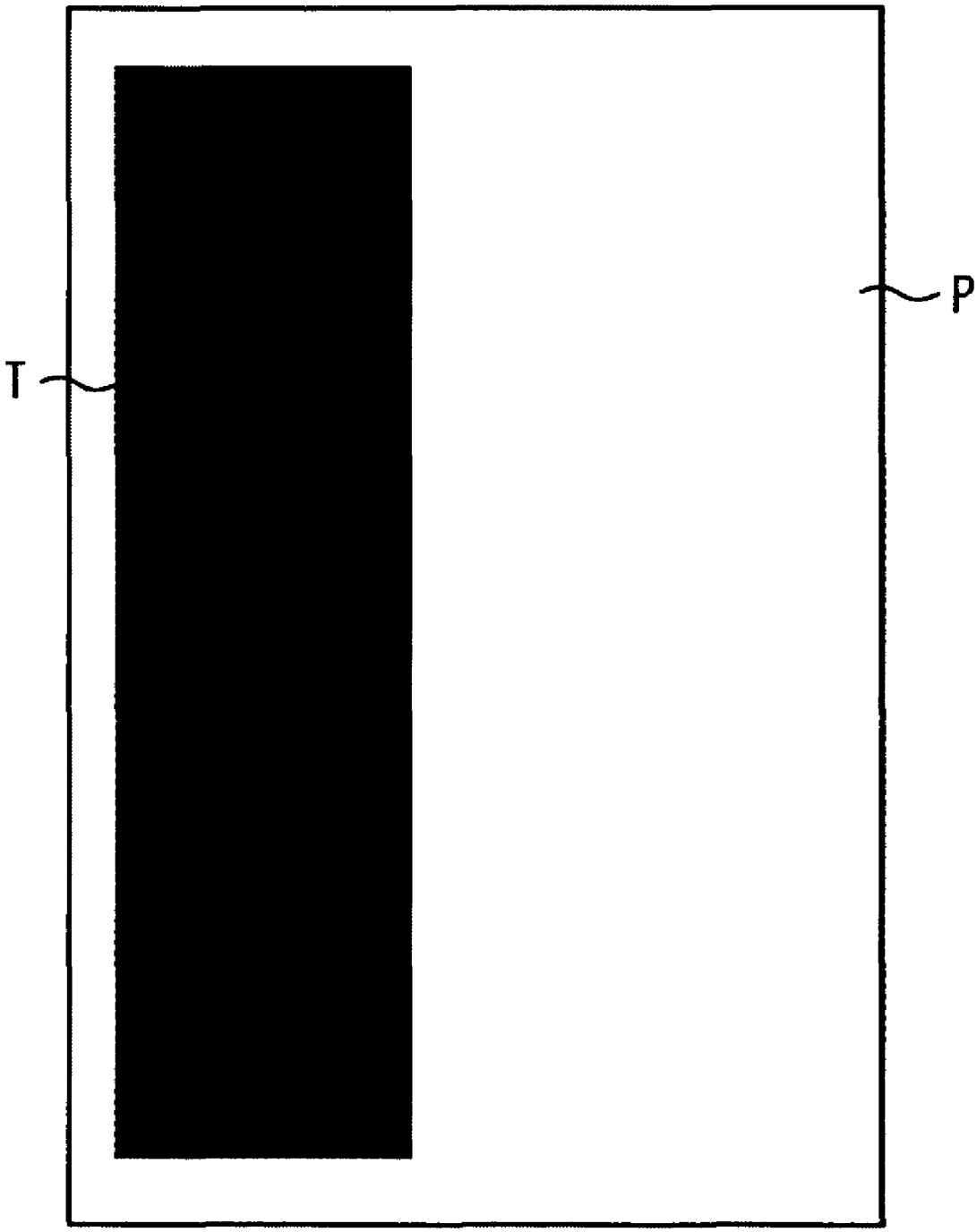
FIG. 9 illustrates an example of an asymmetric toner image according to an exemplary embodiment of the present invention.

For example, it is assumed that an image having a toner image T in the left portion of the transfer material P and having no toner in the left portion is output as illustrated in FIG. 9. In this case, the transfer material conveyance force for the right portion of the transfer material P in FIG. 9 is generated by the frictional force between the back surface of the transfer material P and the transfer member, and the frictional force between the intermediate transfer belt 1 and the front surface of the transfer material P.

On the other hand, with respect to the transfer material conveyance force on the left side of the transfer material P illustrated in FIG. 9, the frictional force generated between the back surface of the transfer material P and the transfer member becomes dominant.

In the case where the toner image T is present only on the left side of the transfer material P (FIG. 9), and the difference between the moving speed of the intermediate transfer belt 1 and the rotational speed of the secondary transfer roller 2 is great, when the image is output, the difference between the conveyance forces for the left and the right portion of the transfer material P becomes great. In this case, the transfer material P cannot be stably conveyed. More specifically, the transfer material P may be conveyed in a skewed posture or may flutter during its conveyance.

In the present exemplary embodiment, a rotational secondary transfer belt is adopted as the transfer member.

Furthermore, in order to more stably convey the transfer material P, it is also useful if the transfer material P is electrostatically attracted to the front surface of the secondary transfer roller before being conveyed to the secondary transfer nip.

Figure 10:
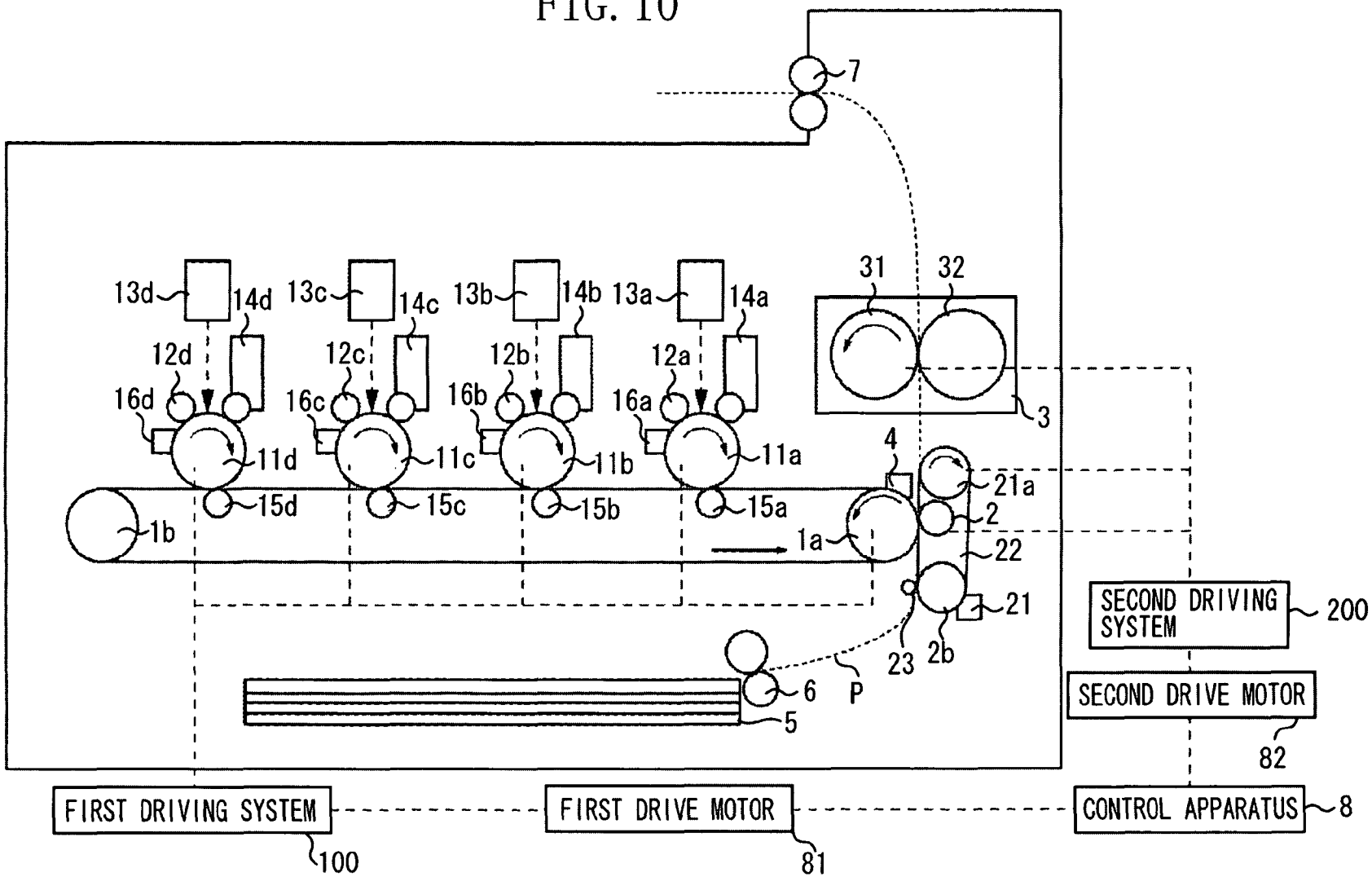
FIG. 10 illustrates an example of a configuration of the entire image forming apparatus according to a second exemplary embodiment of the present invention.

FIG. 10 is a cross section of an electrophotographic image forming apparatus according to the second exemplary embodiment. The units and components of the second exemplary embodiment that are the same as those in the first exemplary embodiment are provided with the same reference numerals and symbols. Accordingly, the description thereof will not be repeated here.

A secondary transfer belt 22, which is the transfer member, is stretched around a secondary transfer belt driving roller 2*a* and a secondary transfer belt driven roller 2*b*.

As the material for the secondary transfer belt 22, a resin film made of a material such as urethane resin, fluorine resin, nylon resin, or polyimide resin can be used, as in the case of the intermediate transfer belt 1. The secondary transfer belt 22 used in the present exemplary embodiment is a single layer endless belt having a thickness of 100 μm. The resistance value thereof has been adjusted so that the volume resistivity ρv becomes $1\times10^{9}$ Ωcm by adding an ion conductive material to polyvinylidene fluoride (PVdF).

A volume resistivity measurement was conducted in compliance with JIS-K6911. Furthermore, the measurement was conducted maintaining a sufficient contact between the electrode and the surface of the belt obtained by using conductive rubber as the electrode. In addition, a high resistance meter (R8340 of ADVANTEST CORPORATION) was used in the measurement.

Furthermore, the measurement was conducted by applying voltage of 100 V for 30 seconds.

In terms of electrostatically attracting the transfer material P, it is useful that the volume resistance of the secondary transfer belt 22 is high. However, if the volume resistance of the secondary transfer belt 22 becomes too high, the secondary transfer belt 22 itself may be charged up. In this case, a mechanism that electrically discharges the secondary transfer belt 22 may become necessary.

In the present exemplary embodiment, in order to realize self attenuation and secure a sufficient paper attraction force, the resistance of the secondary transfer belt 22 is set at the above-described value (ρv=$1\times10^{9}$ Ωcm).

The secondary transfer belt driving roller 2*a* used in the present exemplary embodiment is constituted by an aluminum core and a 3 mm-thick hydrin rubber layer. The roller resistance value has been adjusted to $1\times10^{6}$Ω by adjusting the resistance of the hydrin rubber.

Furthermore, the secondary transfer belt driven roller 2*b* used in the present exemplary embodiment is the aluminum roller. Both the secondary transfer belt driving roller 2*a* and the secondary transfer belt driven roller 2*b* are grounded.

The secondary transfer roller 2 is disposed inside the secondary transfer belt 22 corresponding to the driving roller 1*a* across the intermediate transfer belt 1 and the secondary transfer belt 22. The secondary transfer roller 2 used in the present exemplary embodiment is constituted by a 9 mm-wide core and a single layer roller having the outer diameter of 15 mm.

With respect to the material for the roller, a material prepared by mixing NBR rubber and epichlorohydrin rubber combined with a diphenylamine antioxidant is used. The resistance value of the secondary transfer roller 2 is adjusted to $5\times10^{6}$Ω by using the above-described material. In addition, the rigidity of the secondary transfer roller 2 is set at 35° (ASKER-C).

An attraction roller 23, which electrostatically attracts the transfer material P to the secondary transfer belt 22, is disposed at a position upstream of the secondary transfer nip in the paper conveyance direction. More specifically, the attraction roller 23 is disposed opposed to the secondary transfer belt driven roller 2*b* across the secondary transfer belt 22 to form an attraction unit.

The attraction roller 23 is constituted by a 6 mm-wide core and a solid rubber layer provided thereon. As the solid rubber, ethylene-propylene rubber (EPDM) is used. The resistance value of the attraction roller 23 is adjusted to $1\times10^{5}$Ω by dispersedly mixing carbon black in the solid rubber.

The resistance value of each roller was measured by using an ultra high resistance meter (R8340 of ADVANTEST CORPORATION) while the measurement target roller was contacting an aluminum cylinder having a diameter of 30 mm and was driven therearound.

The measurement was conducted by applying voltage of 100 V for 30 seconds, with the contacting force of 9.8 N, and the rotational peripheral speed of 117 mm/s. An attraction bias (in the present exemplary embodiment, −1,000 V) is applied to the attraction roller 23 by an attraction bias power supply (not illustrated).

A secondary transfer belt cleaner 21 which cleans the toner adhering to the secondary transfer belt 22 is provided on the downstream side of the secondary transfer nip in the paper conveyance direction.

One sheet of the transfer material P is fed by the paper feed unit 6 from the transfer material cassette 5. Then, the fed transfer material P is conveyed to the attraction unit. The transfer material P is electrostatically attracted to the secondary transfer belt 22 in the attraction unit and then is conveyed to the secondary transfer nip.

An optimum bias having a reversed polarity against the charging polarity of the toner and determined according to the temperature and the humidity within the image forming apparatus, which is detected by a temperature and humidity sensor, is applied to the secondary transfer roller 2. The toner image is secondarily transferred from the intermediate transfer belt 1 onto the transfer material P.

The transfer material P that has been electrostatically attracted to the surface of the secondary transfer belt 22 is self stripped from the surface of the secondary transfer nip after passing through the secondary transfer nip, and is conveyed to the fixing device 3.

The secondary transfer belt driving roller 2*a* is rotated by the second driving system 200 in a direction indicated by an arrow in FIG. 10. Thus, the secondary transfer belt 22 is driven by the secondary transfer belt driving roller 2*a*.

The second driving system 200 is driven by the second driving motor 82. The rotation speed of the second driving motor 82 is controlled by the control device 8.

More specifically, the rotational speed of the first driving motor 81, which drives the intermediate transfer belt 1, and the second driving motor 82, which drives the secondary transfer belt driving roller 2*a*, is separately and independently controlled by the control device 8. In other words, the control device 8 controls the moving speed of the secondary transfer belt 22, which is the transfer member.

As in the first exemplary embodiment, in the present exemplary embodiment, the control device 8 controls the moving speed of the secondary transfer belt 22 so that the conveyance speed of the transfer material P at the time of entering the secondary transfer nip becomes slower than the moving speed of the intermediate transfer belt 1 when at least the toner image in the leading edge of the transfer material P in the conveyance direction is transferred.

By performing the above-described control with the control device 8, the present exemplary embodiment can prevent the leading edge E of the transfer material P from pressing the pressing on the toner image T to the intermediate transfer belt.

Furthermore, in the present exemplary embodiment, the control device 8 controls the moving speed of the secondary transfer belt 22 so that the conveyance speed of the transfer material P at the time of exiting the secondary transfer nip is faster than the moving speed of the intermediate transfer belt 1 at least when the toner image in the trailing edge of the transfer material P in the conveyance direction is transferred.

By performing the above-described control with the control device 8, the present exemplary embodiment can prevent the trailing edge E of the transfer material P from stemming the toner image T on the intermediate transfer belt 1.

Figure 11:
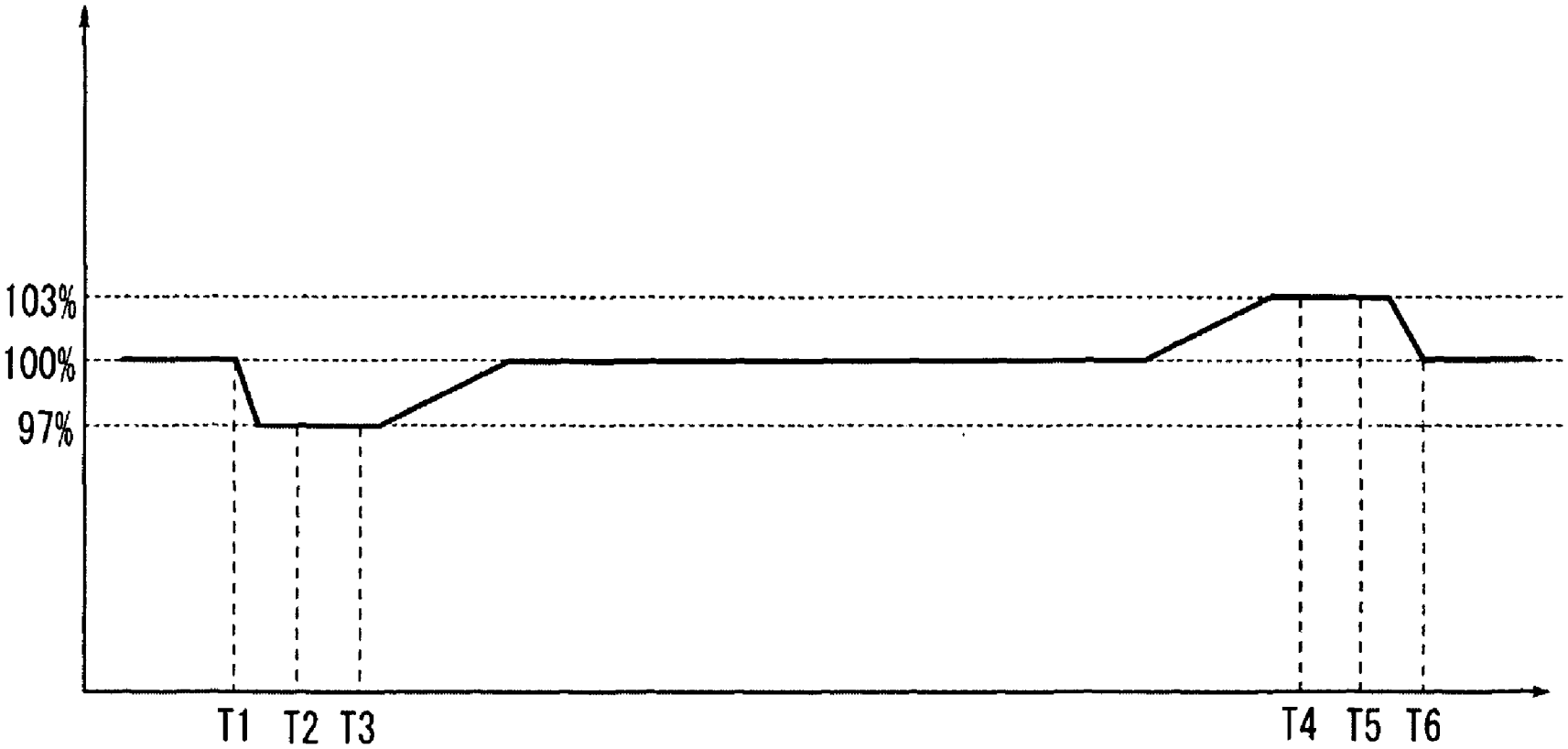
FIG. 11 illustrates an exemplary control executed in the marginless mode according to an exemplary embodiment of the present invention.

FIG. 11 illustrates the variation in the rotational speed of the secondary transfer belt driving roller 2*a* in the case where the toner image is transferred on the entire transfer material P from its leading edge to the trailing edge in the marginless mode according to the present exemplary embodiment.

More specifically, FIG. 11 illustrates the variation in the speed of the secondary transfer belt driving roller 2*a* during the time period from the time the transfer material P, which has been electrostatically attracted to the secondary transfer belt 22, has entered the secondary transfer nip to the time the transfer material P is discharged therefrom.

In an initial state (before a time T1), the rotational speed ratio is 100%. The control device 8 decreases the rotational speed of the secondary transfer belt driving roller 2*a* before the transfer material P enters the secondary transfer nip. More specifically, the control device 8 changes the rotational speed ratio to 97% after the time T1 and before a time T2.

The time T2 is the timing at which the leading edge of the transfer material P enters the secondary transfer nip. A time T3 is the timing at which the leading edge of the transfer material P exits the secondary transfer nip.

As illustrated in FIG. 11, the present exemplary embodiment performs the setting so that the rotational speed of the secondary transfer belt driving roller 2*a* is kept slow during the time period in which the leading edge of the transfer material P is at the secondary transfer nip.

After the leading edge of the transfer material P has passed through the secondary transfer nip, the moving speed ratio is returned to 100% by the control device 8.

After the transfer material P has been slightly conveyed and before the trailing edge of the transfer material P exits the secondary transfer nip, the moving speed is increased to 103% by the control device 8.

A time T4 is the timing at which the trailing edge of the transfer material P enters the secondary transfer nip. A time T5 is the timing at which the trailing edge of the transfer material P exits the secondary transfer nip.

As illustrated in FIG. 11, the present exemplary embodiment performs the setting so that the rotational speed of the secondary transfer roller 2 is kept fast during the time period in which the trailing edge of the transfer material P is at the secondary transfer nip.

After the trailing edge of the transfer material P has exited the secondary transfer nip, the moving speed ratio is returned to 100% by the control device 8.

In the present exemplary embodiment, the rotational speed of the roller is linearly changed on the order of 3% swing from the reference speed. However, the present invention is not limited to this speed.

In the case where the secondary transfer belt 22 is used as the transfer member, the conveyance speed of the transfer material P is substantially the same as the moving speed of the secondary transfer belt 22 because the transfer material P is electrostatically attracted to the secondary transfer belt 22. Accordingly, it is also useful if the rotational speed of the secondary transfer belt driving roller 2*a* is changed on the order of 1% swing.

As described above, the present exemplary embodiment controls the rotational speed of the secondary transfer belt driving roller 2*a* to be slow at the leading edge of the transfer material P so as to suppress or at least reduce the adhesion of the toner to the leading edge or the trailing edge of the transfer material P.

Furthermore, the present exemplary embodiment controls the rotational speed of the secondary transfer belt driving roller 2*a* at the trailing edge of the transfer material P to be fast. Thus, the present exemplary embodiment can suppress or reduce the adhesion of the toner in the edge portions of the transfer material P. As a consequence, the present exemplary embodiment can prevent the image degradation that may occur due to an offset at the fixing unit or the smear in the transfer material conveyance unit.

Furthermore, the present exemplary embodiment employs the secondary transfer belt 22 as the transfer member. With the above-described configuration, the present exemplary embodiment can stably convey the transfer material by conveying the transfer material P attracted to the surface of the secondary transfer belt 22 even in the case of transferring an asymmetric toner image.

In the present exemplary embodiment, the rotational speed of the second driving motor 82 of the second driving system 200 is changed. However, the present invention is not limited to this embodiment. More specifically, it is useful as long as the moving speed of the surface of the transfer member can be changed with respect to the moving speed of the surface of the intermediate transfer belt 1 is changed. For example, it is also useful if the rotational speed of the first driving motor 81 of the first driving system 100 is changed.

Furthermore, it is also useful if the rotational speed of the driving motor is changed using a gear instead of directly changing the rotational speed as described above. In this case, for example, a publicly known gear mechanism (transmission unit) can be used.

In the present exemplary embodiment, the image forming apparatus employs an intermediate transfer belt. However, the present invention is not limited to this embodiment. More specifically, the present invention can be implemented on an image forming apparatus that employs an intermediate transfer drum, an electrostatic transfer member, or a multiplex development unit.

In addition, the same function of the present invention can be applied to a monochromatic image forming apparatus that transfers the toner image directly from a photosensitive drum onto the transfer material P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-323671 filed Dec. 14, 2007, which is hereby incorporated by reference herein in its entirety.

What is claimed is:

1. An image forming apparatus comprising:

an image bearing member configured to bear a toner image and move;

a transfer member configured to form a nip with the image bearing member and move; and a control device configured to control a moving speed of the transfer member, wherein a transfer material is conveyed through the nip and the toner image on the image bearing member is transferred on the transfer material, wherein the image forming apparatus has a marginless mode in which the toner image is formed on said image bearing member in an area that covers the transfer material and an area outside the transfer material, and wherein, at least in a case where the toner image is transferred onto a leading edge of the transfer material in a transfer material conveyance direction in the marginless mode, the control device controls, at least while the leading edge of the transfer material is passing through the nip, the moving speed of the transfer member so that a conveyance speed of the transfer material becomes slower than the moving speed of the toner image on the image bearing member passing through the nip.

2. The image forming apparatus according to claim 1, wherein the control device is configured to control the moving speed of the transfer member so that the conveyance speed of the transfer material after having entered the nip becomes faster than the conveyance speed of the transfer material at the time the transfer material enters the nip.

3. The image forming apparatus according to claim 2, wherein the control device is configured to control the moving speed of the transfer member so that the conveyance speed of the transfer material after entering the nip becomes the same as the moving speed of the image bearing member.

4. The image forming apparatus according to claim 1, wherein the transfer member includes a rotational transfer roller.

5. The image forming apparatus according to claim 1, wherein the transfer member includes a rotational belt.

6. The image forming apparatus according to claim 5, wherein the transfer material enters the nip in a state where the transfer material is attracted to a surface of the rotational belt.

7. The image forming apparatus according to claim 1, further comprising a photosensitive member, wherein the image bearing member includes an intermediate transfer member on which the toner image is transferred from the photosensitive member.

8. An image forming apparatus comprising:

an image bearing member configured to bear a toner image and move;

a transfer member configured to form a nip with the image bearing member and move; and a control device configured to control a moving speed of the transfer member, wherein a transfer material is conveyed through the nip and the toner image on the image bearing member is transferred on the transfer material, wherein the image forming apparatus has a marginless mode in which the toner image is formed on said image bearing member in an area that covers the transfer material and an area outside the transfer material, and wherein, at least in a case where the toner image is transferred onto a leading edge of the transfer material in a transfer material conveyance direction in the marginless mode, the control device controls, at least while a trailing edge of the transfer material is passing through the nip, the moving speed of the transfer member so that a conveyance speed of the transfer material becomes faster than the moving speed of the toner image on the image bearing member passing through the nip.

9. The image forming apparatus according to claim 8, wherein the control device is configured to control the moving speed of the transfer member so that the conveyance speed of the transfer material at the time of exiting the nip becomes faster than the moving speed of the transfer material when the transfer material is conveyed by the nip to transfer the toner image on the image bearing member.

10. The image forming apparatus according to claim 9, wherein the control device is configured to control the moving speed of the transfer member so that the conveyance speed of the transfer material when the transfer material is conveyed by the nip to transfer the toner image on the image bearing member, becomes the same as the moving speed of the image bearing member.

11. The image forming apparatus according to claim 8, wherein the transfer member includes a rotational transfer roller.

12. The image forming apparatus according to claim 8, wherein the transfer member includes a rotational belt.

13. The image forming apparatus according to claim 12, wherein the transfer material enters the nip in a state where the transfer material is attracted to a surface of the rotational belt.

14. The image forming apparatus according to claim 8, further comprising a photosensitive member, wherein the image bearing member includes an intermediate transfer member on which the toner image is transferred from the photosensitive member.

15. An image forming apparatus comprising:

an image bearing member configured to bear a toner image and move;

a transfer member configured to form a nip with the image bearing member and move; and a control device configured to control a moving speed of the transfer member, wherein a transfer material is conveyed through the nip and the toner image on the image bearing member is transferred on the transfer material, wherein the image forming apparatus has a marginless mode in which the toner image is formed on said image bearing member in an area that covers the transfer material and an area outside the transfer material and wherein at least in a case where the toner image is transferred onto a leading edge and a trailing edge of the transfer material in a transfer material conveyance direction in the marginless mode, the control device controls, while the leading edge of the transfer material is passing through the nip, the moving speed of the transfer member so that a conveyance speed of the transfer material becomes slower than the moving speed of the toner image on the image bearing member passing through the nip, and thereafter, the control device controls, while the trailing edge of the transfer material is passing through the nip, the moving speed of the transfer member so that the conveyance speed of the transfer material becomes faster than the moving speed of the toner image on the image bearing member passing through the nip.

16. The image forming apparatus according to claim 15, wherein the control device is configured to control the moving speed of the transfer member so that the conveyance speed of the transfer material after having entered the nip and before exiting the nip is the same as the moving speed of the image bearing member.

17. The image forming apparatus according to claim 15, wherein the transfer member includes a rotational transfer roller.

18. The image forming apparatus according to claim 15, wherein the transfer member includes a rotational belt.

19. The image forming apparatus according to claim 18, wherein the transfer material enters the nip in a state where the transfer material is attracted to a surface of the rotational belt.

20. The image forming apparatus according to claim 15, further comprising a photosensitive member, wherein the image bearing member includes an intermediate transfer member on which the toner image is transferred from the photosensitive member.

* * * * *